US012264571B2

(12) United States Patent
Diehl et al.

(10) Patent No.: US 12,264,571 B2
(45) Date of Patent: Apr. 1, 2025

(54) CONTROL AND MANAGEMENT SYSTEM OF MULTIPHASE STREAMS IN SUBSEA OIL AND GAS PRODUCTION MODULES

(71) Applicants: PETRÓLEO BRASILEIRO S.A.—PETROBRAS, Rio de Janeiro (BR); UNIVERSIDADE FEDERAL DO RIO GRANDE DO SUL—UFRGS, Porto Alegre (BR)

(72) Inventors: Fabio Cesar Diehl, Rio de Janeiro (BR); Marcelo Farenzena, Porto Alegre (BR); Fabio Alves Albuquerque, Rio de Janeiro (BR); Jorge Otávio Trierweiler, Porto Alegre (BR)

(73) Assignees: PETRÓLEO BRASILEIRO S.A.—PETROBRAS, Rio de Janeiro (BR); UNIVERSIDADE FEDERAL DO RIO GRANDE DO SUL—UFRGS, Porto Alegre (BR)

( * ) Notice: Subject to any disclaimer, the term of this patent is extended or adjusted under 35 U.S.C. 154(b) by 0 days.

(21) Appl. No.: 18/517,922

(22) Filed: Nov. 22, 2023

(65) Prior Publication Data

US 2024/0167373 A1 May 23, 2024

(51) Int. Cl.
*E21B 43/01* (2006.01)
*E21B 43/36* (2006.01)

(52) U.S. Cl.
CPC ..... *E21B 43/36* (2013.01); *E21B 43/01* (2013.01)

(58) Field of Classification Search
CPC ..... E21B 43/01; E21B 43/36
See application file for complete search history.

(56) References Cited

U.S. PATENT DOCUMENTS

| | | | | |
|---|---|---|---|---|
| 3,630,002 | A * | 12/1971 | Burrus | E21B 43/36 96/164 |
| 7,819,950 | B2 * | 10/2010 | Stinessen | E21B 43/01 166/357 |
| 11,542,794 | B2 * | 1/2023 | Tønnessen | E21B 34/06 |
| 2004/0245182 | A1 * | 12/2004 | Appleford | E21B 43/34 210/170.11 |

(Continued)

FOREIGN PATENT DOCUMENTS

| | | |
|---|---|---|
| BR | 112016016005-3 | 1/2017 |
| BR | 102015019642-3 | 2/2017 |

(Continued)

*Primary Examiner* — Matthew R Buck
(74) *Attorney, Agent, or Firm* — Womble Bond Dickinson (US) LLP

(57) ABSTRACT

The present disclosure describes a control and management system of multiphase streams in subsea oil and gas production modules. The system comprises (i) a phase separator vessel; (ii) mixing lines; (iii) multiphase, single-phase, pressure, and level variation flow rate measuring instruments; (iv) flow rate and pressure sensors; (v) automatic control valves; and (vi) cascade PID pressure, level, and pressure controllers.

The system control is further carried out by controlling fluid accumulation inventory, controlling the gas-liquid ratio of the stream sent to a first stationary production unit and controlling the gas-liquid ratio of the stream sent to a second stationary production unit so that a maritime field works optimally and without stoppages or bottlenecks.

20 Claims, 7 Drawing Sheets

(56) References Cited

U.S. PATENT DOCUMENTS

2023/0115384 A1 4/2023 Diehl et al.

FOREIGN PATENT DOCUMENTS

| | | | | | |
|---|---|---|---|---|---|
| BR | 102019026341-5 | | | 6/2021 | |
| BR | 102021020223-8 | | | 3/2022 | |
| GB | 2242373 | | | 10/1991 | |
| GB | 2242373 | A | * | 10/1991 | ..... B01D 17/0211 |
| WO | 03/033872 | | | 4/2003 | |
| WO | 2021/209172 | | | 10/2021 | |

* cited by examiner

CONTROL AND MANAGEMENT SYSTEM OF MULTIPHASE STREAMS IN SUBSEA OIL AND GAS PRODUCTION MODULES

FIELD OF DISCLOSURE

The present disclosure pertains to the technical field of oil exploration and production (E&P) and subsea equipment and process technology and describes an arrangement or an engineering and control system for managing the multiphase distribution of underwater currents from oil wells.

BACKGROUND

Stationary Production Units (SPUs), in a very simplified way, are industrial installations located at sea with the function of extracting oil and separating the same into oil, water and gas.

The oil produced can be stored in the unit itself, exported through pipelines or even exported to another SPU or unloaded on shuttle ships using offloading systems.

The water resulting from the separation operation is treated and can return to the well, be used in other applications or be discarded.

The gas is compressed by equipment at the SPU process plant and can be exported, returned to the well to assist in oil recovery or even be discarded by burning through burners installed in the SPUs.

Both the water and gas that return to the well are processes carried out using equipment installed in the process plants of the SPUs.

The development of a maritime oil field normally occurs in sequential mode, that is, the SPUs come into operation in a serial chronological order that aims at meeting criteria for the availability of new SPUs and reservoir management.

A counterpart to this philosophy is that some SPUs in the field tend to operate at the limit of their oil, water or gas processing capacity, while other SPUs may find themselves in a partially idle situation. This is due to a modular view of the production systems, where there is no direct interconnection between the SPUs.

When a SPU reaches maximum processing capacity in one of its main subunits (oil, water or gas treatment plant), it is no longer possible to receive new wells, that is, the platform is bottlenecked. Depending on the field development phase, this situation may occur in the gas or water plant, even if the processing capacity of the oil plant is not being fully utilized.

A solution to this problem could be to send part of the excess fluids to a second nearby SPU. This could be done, for example, from the surface facilities of a SPU-1 to a SPU-2. However, this strategy would generate inefficiencies of different natures, such as: (1) energy inefficiency, due to the fact that fluids are depressurized from the reservoir to be repressurized during transport from one SPU to another; (2) high installation cost, since it is necessary to provide capacity at the plant to minimally treat fluids for export; and (3) opportunity cost of utilizing space in the processing plant that could be used to produce more oil and gas.

These inefficiencies can be eliminated or reduced if the distribution of the oil, gas and water phases of the wells is changed on the seabed in order to optimize the capacity of the SPUs.

Some phase separation systems, such as SSGL (Submarine Gas-Liquid Separation) or SSAO (Submarine Water-Oil Separation), provide gravitational separation of fluids according to their specific masses, generating a light phase and a heavy phase. If the equipment is three-phase, three outlet streams are generated containing a light, a medium and a heavy fluid, according to the separator configuration.

Many fluid separation and stream control studies have been carried out so that the oil field can work in the best possible way.

Document WO 03/033872, from the company Norsk Hydro ASA of 2002, teaches several alternative ways of separating fluids: gas, oil and water, or mixtures of these in separators on the seabed. The separators used are three-phase tube separators. Despite teaching various fluid separation arrangements, the separator used is different from that used in the disclosure under study. Furthermore, no control or process parameters are mentioned.

Document WO 2021/209172, from the company Vetco Gray Scandinavia AS of 2021, discloses a complete modular submarine system capable of separating oil and produced water from gas ($CO_2$) and separating oil from produced water in a second stage, with the objective of Sending only the oil to an oil receiving facility and reinjecting compressed $CO_2$ gas and produced water into the reservoir, typically aided by a pressure boost.

The document further teaches a scalable modular fluid separation system that may further comprise more than one fluid separator (two-phase or three-phase) or further comprise a two-stage three-phase separator (FIG. 4) and the gas reinjection module may further include heat exchangers. Furthermore, the document also provides for more than one three-phase separation module (FIG. 6) or more than one three-phase two-stage separation module (FIG. 7). The focus of the document is the separation of fluids and not the control of the streams that are sent to the SPUs.

Document GB2242373, from the company British Offshore Engineering Technology Limited of 1991, refers to a separator located on the seabed, which separates the solid, gaseous and liquid phases of the product from a submarine oil well, wherein the Solids are retained in the separator, liquids are pumped to the floating mooring system and then to the tanker, and gas is discharged to a surface flare. The separator can discharge oil and water separately, through separator lines, or together through a single line. The system uses several control valves and discharge pumps that are automatically controlled by pressure and level indicators through a common microprocessor that is also located underwater in a separate sealed cabinet, as shown in FIG. 7. Independent flow rate meters can monitor the flows of separate fluids, which can then be recombined for passage through a single pipe. The focus of the document is also the separation of fluids and, in this case, it already uses some automation in its process. However, it does not mention a control management of the streams that are sent to the SPUs nor the possibility of having more than one SPU working together or alternately.

Document BR 102015019642-3, from the company FMC Technologies do Brasil Ltda of 2015, discloses a compact station integrated for subsea fluid separation and pumping systems, which is suitable for application in any subsea system that aims at separating fluids and/or solids and pumping of fluids. The document discloses a modular arrangement for localized intervention in equipment and integration of components for compacting and reducing the size and weight of modules, thus composing an improved subsea system for three-phase separation of fluids and pumping.

Document BR 112016016005-3, from the company EXXONMOBIL UPSTREAM RESEARCH COMPANY of 2015, discloses a polyphase separation system for separating production fluids that can be obtained from a subsea well. The polyphase fluid can be any type of fluid that includes components of an aqueous phase and an oil phase that are relatively immiscible. The production fluids can be hydrocarbon fluids that include a mixture of natural gas, crude oil, brine and solid impurities such as sand. The focus of the document is also the separation of fluids and, in this case, it is a polyphase separation. However, it does not mention a control management of the streams that are sent to the SPUs nor the possibility of having more than one SPU working together alternately.

Document BR 102019026341-5 from Petrobras of 2019 discloses submarine arrangements in which the lines that interconnect the producing wells to a given SPU are arranged in such a way as to allow a certain group of producing wells to be interconnected, at the same time, to more than one SPU, through different configurations. The document proposes the use of one or more subsea separation systems associated with one or more wells and two or more SPUs, so that this makes it possible to separate and recombine the water, gas and oil fractions into two streams, to be fully elevated through risers to the surface units, with compositions optimized according to the processing capacity of each SPU. In this way, the subsea system sends a flow with a higher proportion of oil to a SPU "filled" with liquid (that is, completely using its processing capacity). The second SPU, idle in terms of liquid treatment capacity, receives a composition with a higher proportion of water. The same reasoning can be applied in relation to gas, if this is the determining variable of capacities at a given moment. To this end, the document discloses the use of a configuration of a production circuit, such as a collection ring, production loop, or production ring, simple or compound, with each end interconnecting to a different SPU, for the purpose of optimizing distribution production and guaranteed flow. This solution can present three different arrangements, as shown in FIGS. 4, 5 and 6 of the document. However, it results in a more complex structure than that proposed in the present disclosure.

Document BR 102021020223-8 from Petrobras of 2021 is the document that is the closest regarding the matter of the present patent application. It teaches a system that allows controlled mixing of streams exported by two-phase or three-phase separators, enabling phase management according to the processing needs of the SPUs. The outlet streams of the subsea separation modules can be routed to different SPUs in order to optimize the processing capacity of the surface plant.

The system is also capable of manipulating process parameters such as Gas-Liquid Ratio (RGL), Gas-Oil Ratio (RGO) or Water cut (amount of water in the oil) in real time to generate the multiphase streams required by each SPU, using the own autogenous pressure of the process to carry out this adjustment, that is, without the need for pressure lifting systems or artificial elevation (pumps, compressors, gas lift, etc.) of the export streams of the system. This is possible through a cross-flow injection control system between phases. However, the document also does not exclude the possibility of using pressure raising systems (pumps, compressors, etc.), if the SPUs are at high distances and require the use of this device.

The system can further be connected directly to the producing wells without the need to be connected to a subsea separation module or it can be connected at the outlet of the subsea separators directly to the producing wells to manage the phases that will be directed to the SPUs.

The arrangement or system, object of this patent, is an alternative to the system proposed in patent application BR 102021020223-8, the structure being less complex and more robust from an operational perspective, which allows the arrangement of the present disclosure to support pressure disturbances of high magnitude, which makes it more efficient, flexible and autonomous than the arrangement taught in patent application BR 102021020223-8. Technically, the main difference between the arrangement proposed in the present disclosure and the arrangement taught in patent application BR 102021020223-8 consists in the fact that the streams manipulated for phase management originate in different locations in the process flowchart: the arrangement taught in the application BR 102021020223-8 is based on bifurcations of light and heavy product lines, while the arrangement taught in the present disclosure uses line derivations originating from the phase separator vessel itself. This difference makes it possible to transfer disturbances in the pressure balance to the separator vessel, which has a larger volume than the lines and, consequently, makes the arrangement more robust to the expected variations in production. This improvement in the robustness of the arrangement/system of the present disclosure compared to the arrangement of BR 102021020003-8 allows the control loops of the arrangement of the present disclosure to be simplified and the number of necessary subsea equipment reduced (valves and control loops), which results in in a reduction in project cost and less interaction between equipment, facilitating system operation.

Furthermore, due to the difference in the origin of the manipulated streams, the arrangement of patent application BR 102021020003-8 needs to guarantee a positive pressure balance between the process nodes to avoid reverse flow. The arrangement of the present disclosure has this feature intrinsically guaranteed by the origin of the single-phase streams being in the separation vessel itself. This avoids situations of reverse flow from one branch to another and reduces the effects of flow rate fluctuations due to pressure variations downstream of the mixing valves, which represents an operational advantage compared to the arrangement in patent application BR 102021020003-8.

Thus, it is clear that the documents cited and commented above do not present similar arrangements or systems nor the possible technical advantages of the present disclosure. Therefore, it is possible to note that the state of the art lacks an engineering and control arrangement for managing the multiphase distribution of the underwater currents from oil wells, as detailed below.

SUMMARY OF THE DISCLOSURE

The central idea of the arrangement of the present patent application consists of removing multiple single-phase streams from subsea separation equipment (SSGL, SSAO, etc.) that, mixed in a controlled manner, generate streams with specific phase distribution for the maximum use of the processing capacity of the SPUs. To achieve this, the disclosure relies on single-phase fluid outlets from the separation vessel(s) that are subsequently mixed in a controller-assisted manner to meet the optimization specifications of the processing plants of different SPUs. A key point of this disclosure is that the single-phase outlets originate from nozzles in the separation vessels and not from line derivations. Thus, the system uses the capacitance of the separator vessel(s) itself to dampen exogenous pressure disturbances. This difference in the engineering arrangement of the S2M2 presents operational advantages, as it allows the module to operate in a more robust manner, resulting in fewer operational problems such as unscheduled stoppages and excessive manipulation of control valves (which have their useful life reduced by excessive cycling).

Therefore, the objective of the present disclosure is to describe an engineering and control arrangement for managing the distribution of liquid and gas between two SPUs. Such an arrangement makes it possible to debottleneck the SPU-A gas plant by sending part of the gas stream from this unit to SPU-B. On the other hand, part of the liquid that would be sent to SPU-A is destined for SPU-B. RGL values between platforms can be adjusted by the field operation management teams.

The control and management arrangement/system of multiphase streams in subsea oil and gas production modules proposed by the present disclosure comprises (i) a phase separator vessel; (ii) mixing lines; (iii) multiphase (RGLT-01, RGLT-02), single-phase (FIC-01, FIC-02), pressure (PIC-01) and level (LIC-01) variation flow rate measuring instruments; (iv) flow rate (FT-01, FT-02) and pressure (PT-01) sensors; (v) automatic control valves (V-01, V-02, V-03, V-04); and (vi) cascade proportional-integral-derivative (PID) pressure (FFIC-01, FFIC-02), (FIC-01, FIC-02), level (LIC-01) and pressure (PIC-01) controllers.

DETAILED DESCRIPTION

Figure 1:
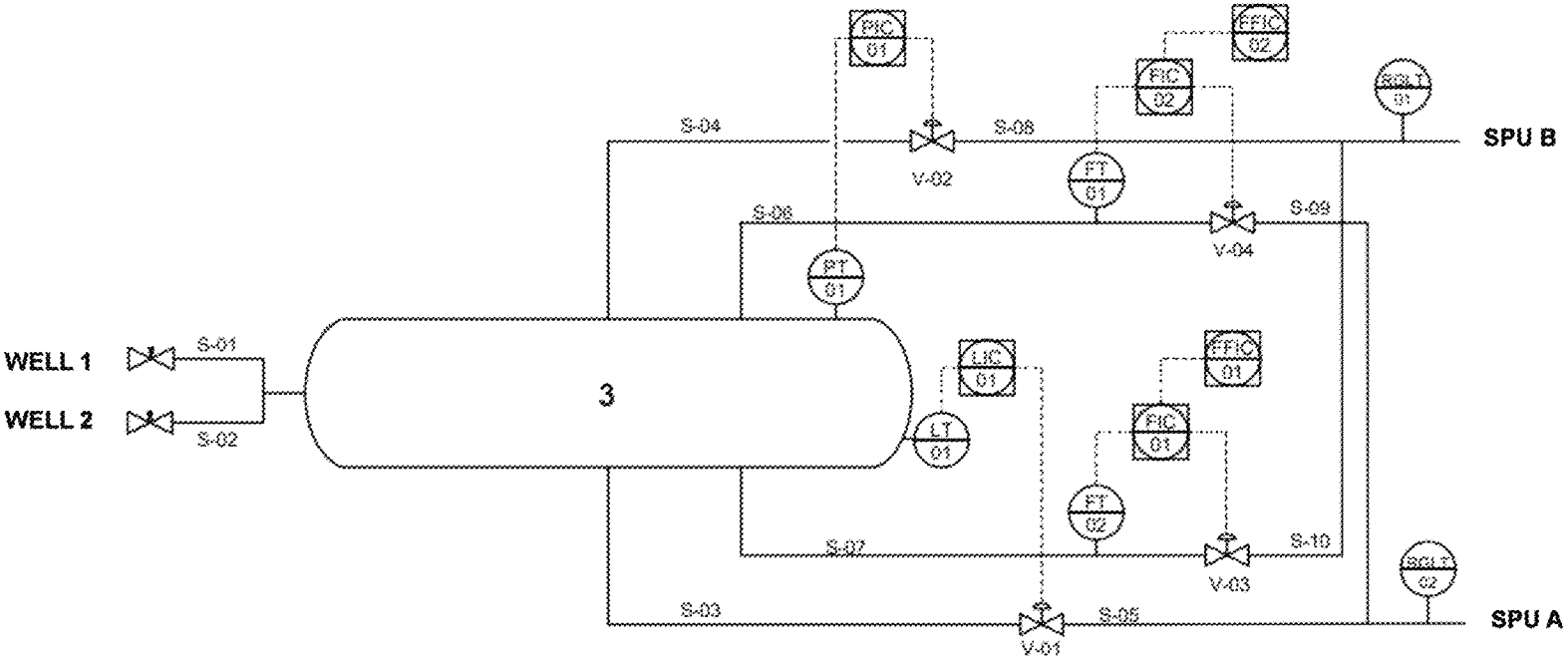
FIG. 1 is a flowchart of the multiphase stream management system in subsea modules (Subsea System for Multiphase Management—S2M2) for oil and gas production proposed by the present disclosure.

The engineering arrangement or control system for managing the multiphase distribution of streams in subsea oil and gas production modules proposed by the present disclosure is described based on the manipulation of fluid flows in order to achieve the intended phase distribution and in the stream control strategy to generate export streams for different SPUs with RGL adjusted according to the optimization needs of the units. The entire description is based on the generic flowchart in FIG. 1.

Fluid Flow

In more detail, oil and gas producing wells are routed to a gravity separator on the seabed. In the example of this patent, two wells were considered (Well-01 and Well-02); however, the concept can be applied to as many wells as desired. The wells arrive at the phase separator vessel (3) via the streams S-01 and S-02.

The phase separator vessel (3) uses the principle of the difference in specific mass between the phases (gas, oil and water) to carry out the desired separation. To do this, the vessel needs a volume that allows sufficient time for phase separation. This volume is defined according to the characteristics of the fluids in each field and its particular wells, following well-defined sizing rules in the processing industry. The heavy phase(s) (high specific mass) is/are removed through the bottom of the vessel, while the light phase (low specific mass) is removed through the top of the vessel. In the example in FIG. 1, the heavy phases are removed from the separator vessel (3) by two streams: S-03 and S-07. In this case, these streams are removing liquids (oil and water) from the vessel. The S-04 and S-06 streams remove the light phase from the vessel, composed of a gaseous mixture of hydrocarbons and contaminants, such as $CO_2$, $H_2S$, etc.

The high specific mass stream S-07 passes through the control valve V-03 and changes name to stream S-10. This stream is injected into the S-08 stream, composed of low specific mass fluid, so that the proportion between the phases sent to the SPU-B is manipulated.

The same occurs with the low specific mass stream S-06 that, when passing through the control valve V-04, changes its nomenclature to S-09 and is injected into the high specific mass stream S-05 to adjust the proportion of phases that are sent to SPU-A.

Control valves V-01 and V-02 control the inventory of the separator vessel (fluid accumulation), while control valves V-03 and V-04 are responsible for controlling the injection flow rate of the heavy phase in the light stream and the light phase in the heavy stream, respectively. The control of the injection flow rate carried out by valves V-03 and V-04 is guided by the proportion/ratio of gas and liquid (RGL) in the export streams—a value quantified by the meters RGLT-01/02.

Control Strategy

Inventory Control

Inventory control is responsible for controlling the accumulations of matter in the phase separator vessel (3), that is, the liquid level and gas pressure.

The level indicator controller LIC-01 is responsible for maintaining a liquid level in the separator vessel. This level is responsible for sealing the liquid outlet and ensuring that gases do not enter the lower streams of the vessel. The control is done by reading the level meter/transmitter LT-01 and acting on the valve V-01.

The pressure indicator controller PIC-01 keeps the vessel pressure under control, ensuring residence time for the gas not to draw liquid to the top outlets of the vessel. Control is done by reading the signal from the pressure meter/transmitter PT-01 and acting on valve V-02.

RLG Control of the Stream Sent to the SPU-A

The meter RGLT-02 checks the proportion of gas and liquid in the stream exported to the SPU-A and sends this information to the RGL indicator controller called FFIC-02. This controller, in turn, commands the loop FIC-02 that defines the amount of gas that must be injected into the stream S-05, so that the RGL is adjusted according to the operationally desired value.

RLG Control of the Stream Sent to the SPU-B

The meter RGLT-01 checks the proportion of gas and liquid in the stream exported to the SPU-B and sends this information to the RGL indicator controller called FFIC-01. This controller, in turn, commands the loop FIC-01 that defines the amount of liquid that must be injected into the stream S-08 so that the RGL is adjusted according to the operationally desired value.

Result of the Numerical Simulations of the S2M2 System

Figure 2:
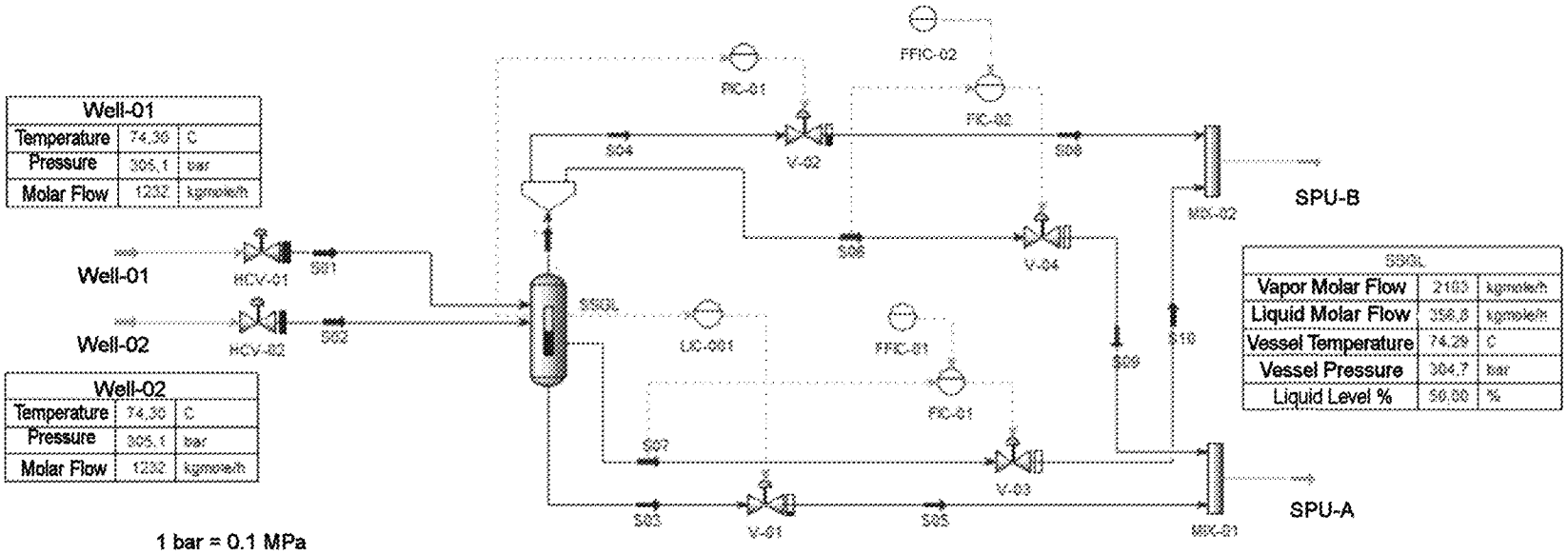
FIG. 2 is a flowchart of S2M2 with process simulation data.

The results of the numerical simulations of the S2M2 system come from the process flowchart presented in FIG. 2.

The tests were carried out to evaluate the two main expected features of the module: (1) servo ability, that is, the ability to meet the set point references delivered to the system, and (2) regulatory ability, that is, the ability to maintain set point references even in situations where external disturbances occur.

Figure 3:
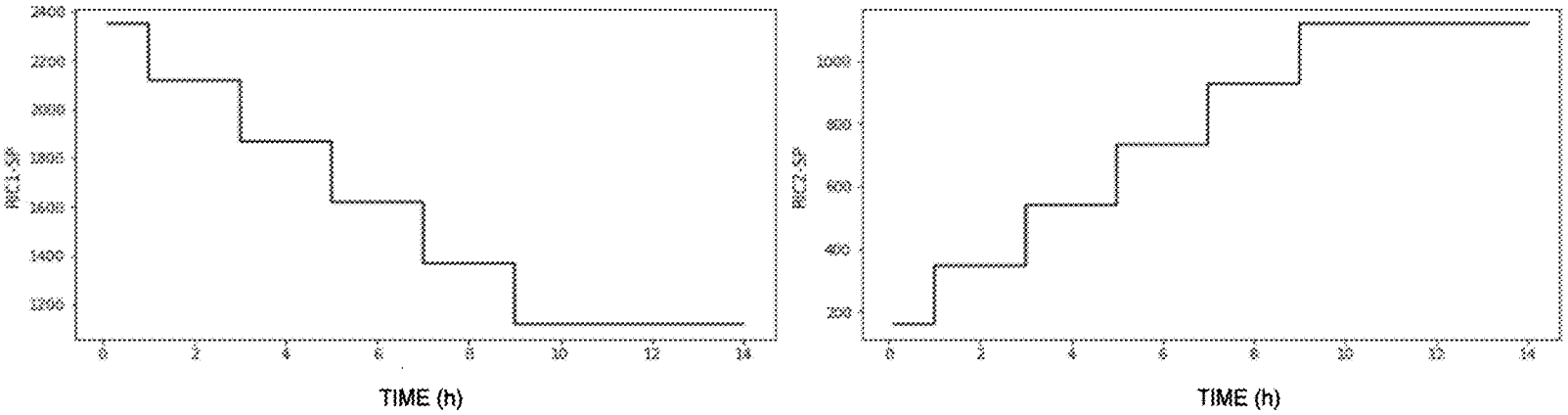
FIG. 3 shows the change in the RGL set point of the S2M2.

Servo feature: a set of different set point references was applied to the desired RGL values for the export streams going to SPUs-A/B (RIC1 and RIC2). These RGL values are provided to the S2M2 control system in the form of a set point (SP) (reference value) and are presented in FIG. 3.

Figure 4:
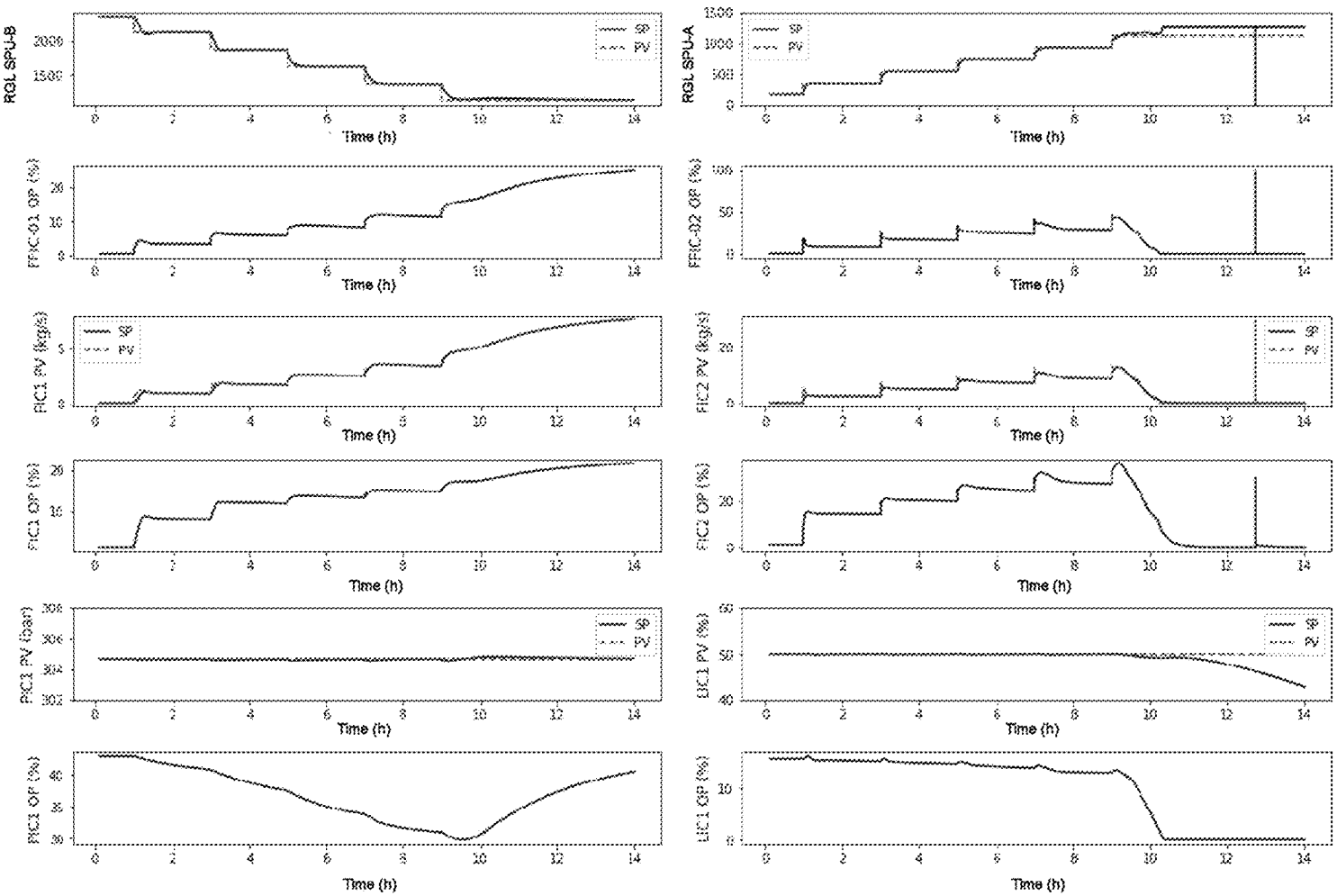
FIG. 4 shows the servo feature.

The response of the S2M2 is shown in FIG. 4, where the PID (proportional-integral-derivative) controllers adjust the outlets of the controllers FFIC-01/02, generating new flow references for the controllers FIC-01/02, which, in turn, calculate the opening values of the valves V-03 and V-04. These flow rates of the FIC-01/02 are manipulated with the aim of readjusting the RGL values of the streams S-05 and S-08 and, in this way, meeting the defined RGL set point references. The level control LIC-01 and pressure control PIC-01 loops are activated to regulate and maintain their set points even under disturbances in FIC-01/02 flow rates and, in this way, guarantee system inventory control (amounts of liquid and gaseous matter required for the proper functioning of phase separation in the separator vessel). The results show that S2M2 can control the RGL of export streams as expected. The good performance of the strategy can be seen in the graphs of RGL values arriving from the SPUs (RGL SPU-A and RGL SPU-B graph) in FIG. 4.

Regulatory feature: to evaluate the regulatory capacity of S2M2, disturbances were generated in the pressure of the export lines (flowline) for SPUs-A/B. These disturbances simulate, for example, the change in the opening of well production valves on the platforms and are presented in FIG. 5. The disturbances were applied at intense levels, varying up to 100 bar (10 MPa) suddenly in the export streams of the SPU-A and SPU-B simulation. All S2M2 set point reference values were kept constant, forcing the control system to work to always maintain reference operational levels, even under the influence of these disturbances. As a result, it is ascertained that all control loops work with the same objective and are able to meet specifications, rejecting the disturbances after some dynamic transient, which is normally expected in automatic control systems in processing plants. The performance can be seen in the graphs FFIC1-RGL and FFIC2-RGL in FIG. 6, where the RGL reference values were maintained at the defined levels of 2100 and 400 even under strong pressure disturbances in the export lines. Therefore, the regulatory feature of S2M2 appears to be highly robust and efficient.

Analysis of Results

The result for the servo feature, that is, for the operating point change capacity, is presented in FIG. 4. For this case, it is possible to take the high RGL export stream from 1,400 to a maximum of 2,400, while the low RGL stream can be adjusted between a minimum of 180 and 950. The minimum and maximum RGL conditions are defined by the equilibrium thermodynamics of the mixture, which depends on the composition of the wells, pressure and temperature of the separator. The S2M2 is not designed to generate streams in export conditions very close to the input RGL condition, in this case 1,150; therefore, the controllability of the system may be compromised in this situation. However, this is not a problem, because the objective of the S2M2 is not to generate streams with RGL very close to the arrival conditions of the subsea processing plant.

Figure 5:
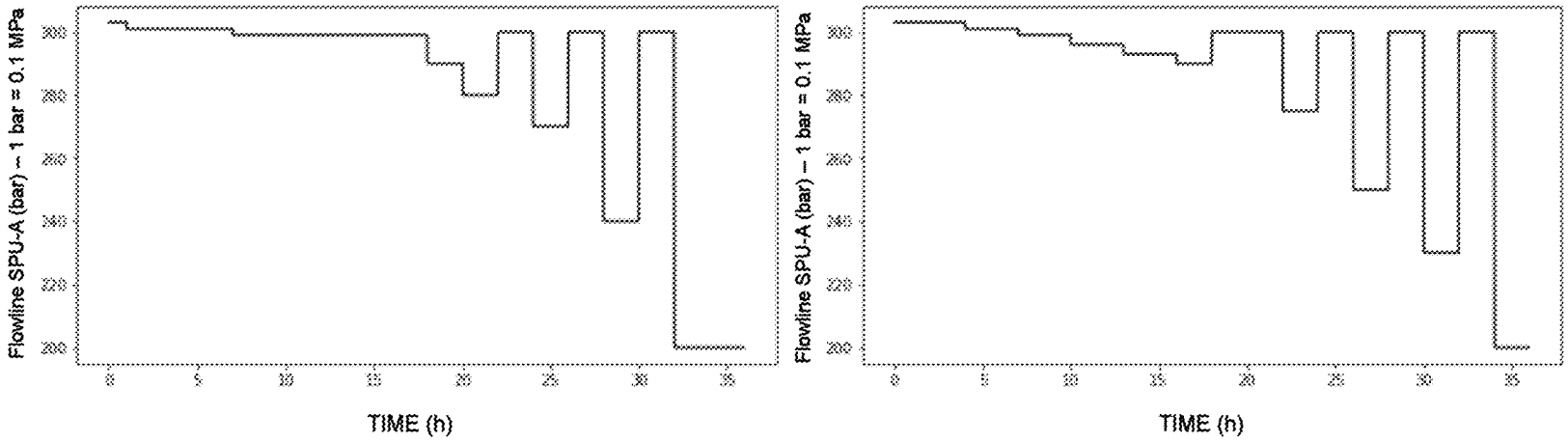
FIG. 5 shows the disturbances in the export line pressure for SPU-A and SPU-B during the S2M2 process simulation.

As for the regulatory feature, that is, for the ability to reject disturbances and maintain continuity of operation, the disturbances presented in FIG. 5 were applied. These disturbances represent variations in the export lines to the SPUs and the magnitude of the disturbances reached 100 bar (10 MPa) at different times between the SPU-A and SPU-B lines.

Figure 6:
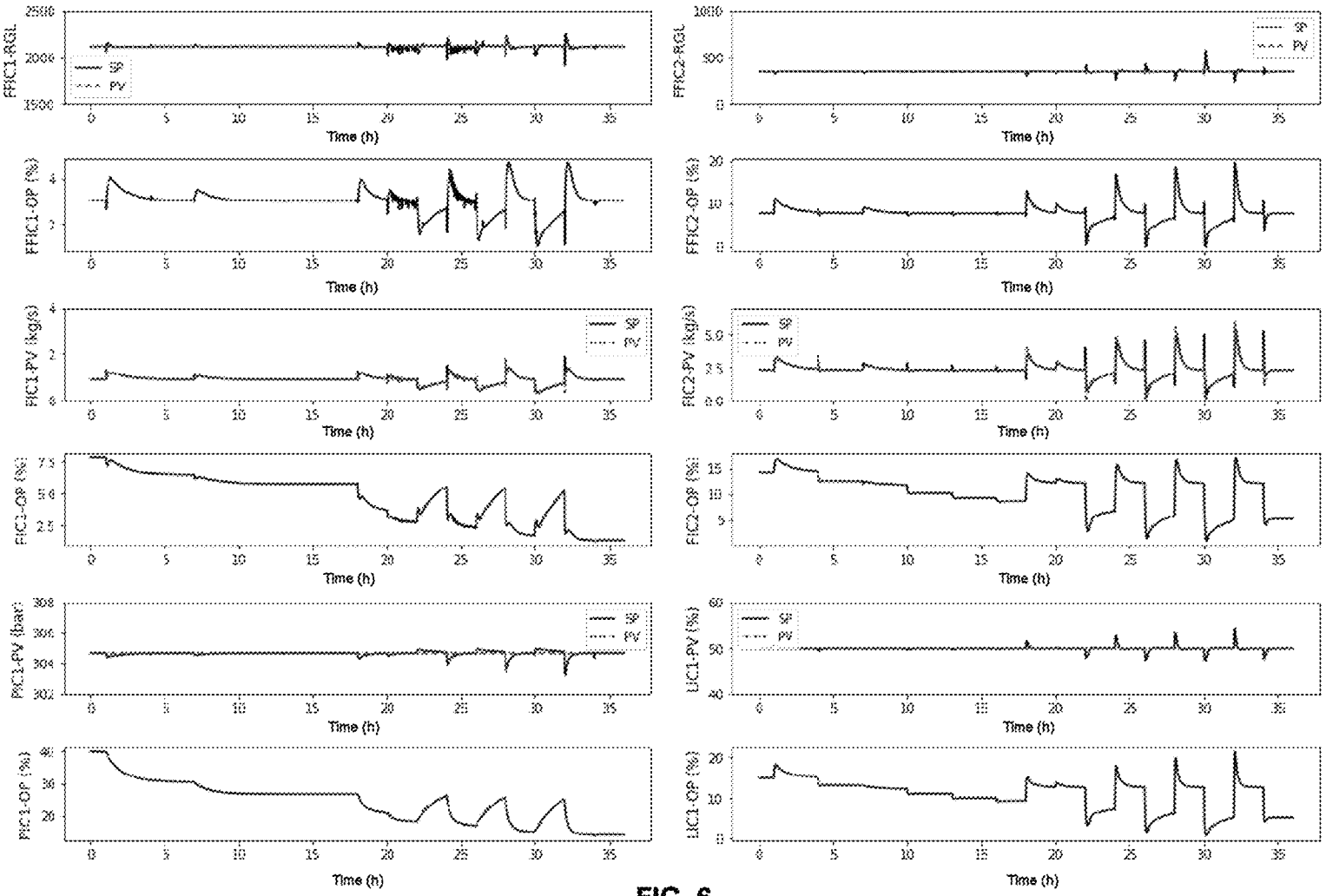
FIG. 6 shows the regulatory feature.

The results presented in FIG. 6 show that the S2M2 is capable of resisting high intensity disturbances, maintaining the RGL constant, even during intense pressure variations. This represents about 20% and 80% of the total RGL range respectively between the minimum and maximum achievable by the separation system under the conditions of this example. No reverse flow or significant interactions between control loops are observed in S2M2.

Figure 7:
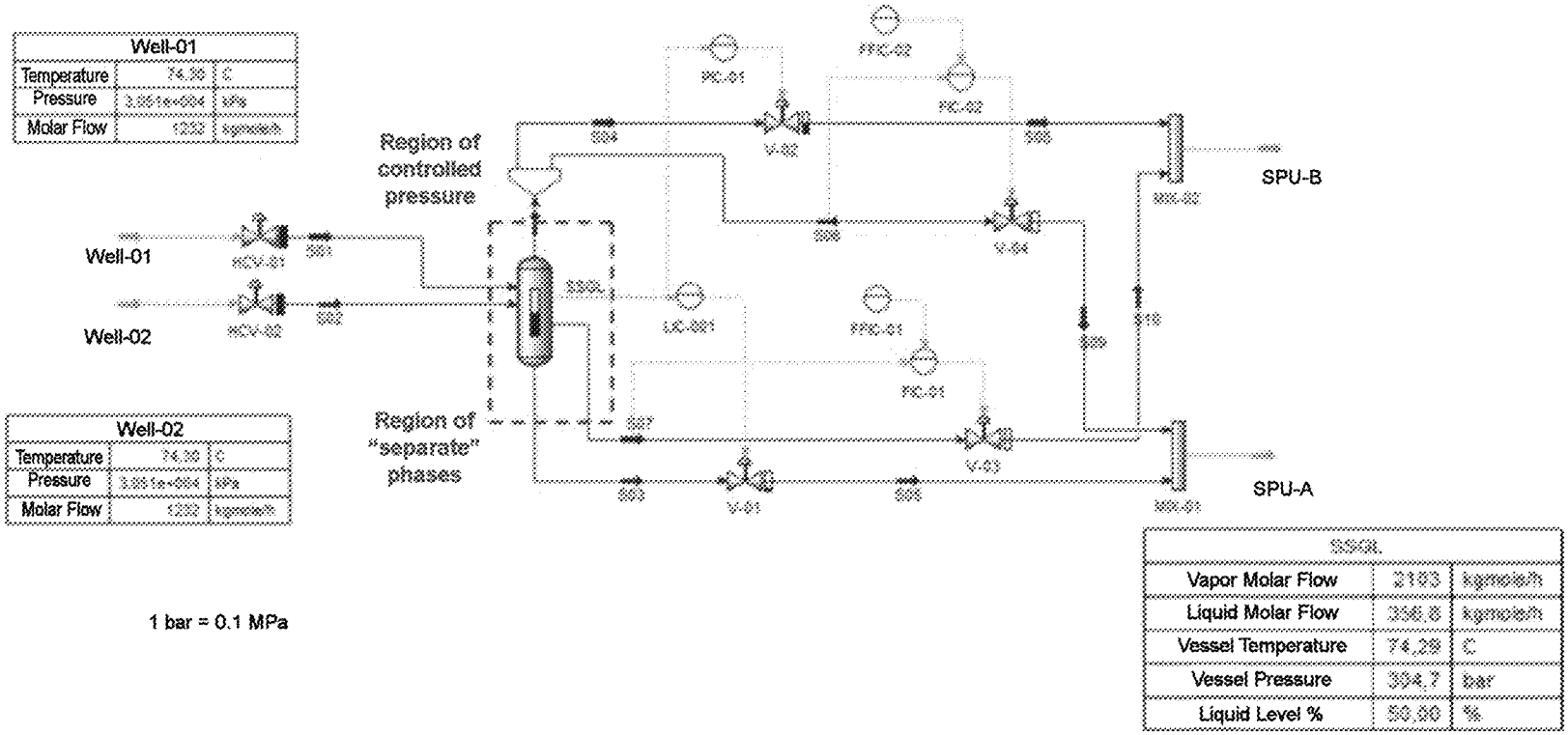
FIG. 7 shows the controlled pressure point of the S2M2 submarine module of the disclosure with the most robust operating configuration for removing mixing streams.

The high operational robustness of the processing system presented in this disclosure is strongly linked to the points of removing streams from the separation vessel. These points are strategically designed to remove single-phase streams from a point in the process with controlled pressure, as shown in FIG. 7.

The invention claimed in:

1. A control and management system of multiphase streams in subsea oil and gas production modules, the system comprising (i) a phase separator vessel; (ii) mixing lines; (iii) multiphase measuring instruments; (iv) flow rate, level, and pressure sensors; (v) a plurality of control valves; and (vi) cascade proportional-integral-derivative (PID) flow rate, level, and pressure controllers, wherein the multiphase measuring instruments indicate gas-liquid ratios that are configured to be used to command the flow rate controllers.

2. The system according to claim 1, wherein the phase separator vessel receives the streams coming from wells and separates the streams into heavy and light streams.

3. The system according to claim 2, wherein the heavy stream is removed through a bottom of the separator vessel, and wherein the light stream is removed through a top of the separator vessel.

4. The system according to claim 1, wherein an origin of multiple single-phase streams is located in the separator vessel.

5. The system according to claim 2, wherein the heavy stream passes through one or more of the plurality of control valves and is injected in a stream composed of low specific mass fluid, so that the proportion between phases is manipulated.

6. The system according to claim 2, wherein the light stream passes through one or more of the plurality of control valves and is injected in a high specific mass stream, thereby to adjust the proportion of the phases.

7. The system according to claim 2, wherein a first portion of the plurality of control valves control fluid accumulation of the separator vessel, and wherein a second portion of the plurality of control valves control an injection flow rate of the heavy stream into the light stream and the light stream into the heavy stream, respectively.

8. The system according to claim 1, wherein control of an injection flow rate carried out by one or more of the plurality of control valves is guided by a ratio of gas and liquid in export streams, and wherein a value of the ratio is quantified by one or more meters.

9. The system according to claim 1, wherein system control is carried out by controlling fluid accumulation inventory, controlling a gas-liquid ratio of a stream sent to a first stationary production unit and controlling a gas-liquid ratio of a stream sent to a second stationary production unit.

10. The system according to claim 9, wherein the fluid accumulation inventory control controls a liquid level and a gas pressure in the separator vessel.

11. The system according to claim 9, wherein a liquid level in the separator vessel is controlled by a level control loop, which includes the level controller, a level transmitter and a first portion of the plurality of control valves.

12. The system according to claim 11, wherein a pressure in the separator vessel is controlled by a pressure control loop, which includes the pressure controller, a pressure transmitter, and a second portion of the plurality of control valves.

13. The system according to claim 9, wherein the gas-liquid ratio control of the stream sent to the first stationary production unit is carried out by a meter that checks the ratio of gas and liquid in the stream exported to the first stationary production unit and sends this information to a ratio gas-liquid indicator controller, and the indicator controller, in turn, commands a loop that defines an amount of gas that must be injected into the stream so that the gas-liquid ratio is adjusted according to the operationally desired value.

14. The system according to claim 9, wherein the gas-liquid ratio control of the stream sent to the second stationary production unit is carried out by a meter checking the ratio of gas and liquid in the stream exported to the second stationary production unit, and sends this information to a gas-liquid ratio indicator controller, and wherein the indicator controller, in turn, commands a loop that defines an amount of liquid to be injected into the stream so that the gas-liquid ratio is adjusted according to an operationally desired value.

15. The system according to claim 1, wherein the system uses capacitance of the separator vessel to dampen exogenous pressure disturbances by removing multiple streams from the separator vessel to achieve controlled mixing of the phases.

16. A control and management system of multiphase streams in subsea oil and gas production modules, the system comprising (i) a phase separator vessel; (ii) mixing lines; (iii) multiphase, single-phase, pressure, and level variation flow rate measuring instruments; (iv) flow rate, level, and pressure sensors; (v) one or more control valves; and (vi) cascade proportional-integral-derivative (PID) flow rate, level, and pressure controllers, and wherein system control is carried out by controlling fluid accumulation inventory, controlling a gas-liquid ratio of a stream sent to a first stationary production unit, and controlling a gas-liquid ratio of a stream sent to a second stationary production unit.

17. The system according to claim 16, wherein the fluid accumulation inventory control controls a liquid level and a gas pressure in the separator vessel.

18. The system according to claim 16, wherein a liquid level in the separator vessel is controlled by a level control loop, which includes the level controller, a level transmitter and at least one of the one or more control valves.

19. The system according to claim 18, wherein a pressure in the separator vessel is controlled by a pressure control loop, which includes the pressure controller, a pressure transmitter, and at least one of the one or more control valves.

20. The system according to claim 16, wherein the gas-liquid ratio control of the stream sent to the first stationary production unit is carried out by a meter that checks the ratio of gas and liquid in the stream exported to the first stationary production unit and sends this information to a ratio gas-liquid indicator controller, and the indicator controller, in turn, commands a loop that defines an amount of gas that must be injected into the stream so that the gas-liquid ratio is adjusted according to the operationally desired value.

* * * * *